US012370428B2

(12) United States Patent
Tribelhorn

(10) Patent No.: US 12,370,428 B2
(45) Date of Patent: Jul. 29, 2025

(54) FRISBEE HOLDER

(71) Applicant: Erik W. Tribelhorn, Yuma, CO (US)

(72) Inventor: Erik W. Tribelhorn, Yuma, CO (US)

( * ) Notice: Subject to any disclaimer, the term of this patent is extended or adjusted under 35 U.S.C. 154(b) by 0 days.

(21) Appl. No.: 18/401,939

(22) Filed: Jan. 2, 2024

(65) Prior Publication Data

US 2025/0213953 A1 Jul. 3, 2025

(51) Int. Cl.
*A63B 71/00* (2006.01)

(52) U.S. Cl.
CPC ..... *A63B 71/0036* (2013.01); *A63B 2244/15* (2013.01)

(58) Field of Classification Search
CPC ..... A47K 10/04; A47K 10/10; A47B 96/027; A63B 71/0036; A63B 2244/15
USPC ..... 211/85.7, 41.1, 41.2, 16, 88.04
See application file for complete search history.

(56) References Cited

U.S. PATENT DOCUMENTS 913,228 A * 2/1909 McCarthy ..... B61D 37/003 224/29.5
1,677,764 A * 7/1928 Gloekler ..... A47J 47/16 193/38
2,606,667 A * 8/1952 Hornick ..... A47K 10/10 211/124
3,233,852 A * 2/1966 Azar ..... A47B 96/027 248/68.1
4,854,456 A * 8/1989 Lee ..... A47B 81/007 211/175
4,870,907 A * 10/1989 McKee ..... A47K 10/04 108/42
4,936,467 A * 6/1990 Bobeczko ..... A47F 7/00 211/175
4,997,116 A * 3/1991 Grim ..... B60R 9/06 224/532
5,092,546 A * 3/1992 Wolfbauer ..... F16L 3/24 211/208
5,253,837 A * 10/1993 Loux ..... A47G 25/0692 211/90.01
5,310,148 A * 5/1994 Dorr ..... A47B 96/061 248/223.41
5,351,842 A * 10/1994 Remmers ..... A47F 5/08 108/29
5,373,950 A * 12/1994 Marc ..... D06F 57/12 211/88.04
5,706,737 A * 1/1998 Whitehead ..... A47B 96/02 108/42
5,871,105 A * 2/1999 Whitehead ..... A63B 71/0045 211/14

(Continued)

*Primary Examiner* — Patrick D Hawn

(57) ABSTRACT

According to an aspect of the present invention, there is provided a disc holder, comprising: a first end plate; a first mounting bracket; a second end plate; a second mounting bracket; a first tube; and a second tube, wherein: the first end plate is configured to attach to the first mounting bracket; the second end plate is configured to attach to the second mounting bracket; the first tube connects the assembly of the first end plate and the first mounting bracket to the second end plate and the second mounting bracket along a first line; and the second tube connects the assembly of the first end plate and the first mounting bracket to the second end plate and the second mounting bracket along a second line to define a space for holding discs between the first tube and the second tube.

7 Claims, 4 Drawing Sheets

(56) References Cited

U.S. PATENT DOCUMENTS 6,138,841 A * 10/2000 Klein ..... A47G 25/10 D6/552
6,164,465 A * 12/2000 Schroeder ..... A63B 71/0036 211/85.7
6,257,425 B1 * 7/2001 Liu ..... A47K 10/04 211/90.01
6,334,541 B1 * 1/2002 Chang ..... A47K 10/10 248/214
6,464,086 B1 * 10/2002 Klein ..... A47F 7/08 211/35
6,561,364 B1 * 5/2003 Brunsden ..... A47K 10/04 211/90.01
6,581,788 B1 * 6/2003 Winig ..... F16B 12/26 211/183
6,604,639 B2 * 8/2003 Chen ..... A47F 7/00 D6/552
6,920,989 B2 * 7/2005 Lin ..... A47K 10/10 211/87.01
7,025,214 B2 * 4/2006 Klein ..... A47B 61/04 211/35
7,150,364 B2 * 12/2006 Jablow ..... A47B 45/00 211/175
7,201,282 B1 * 4/2007 Alderman ..... A47B 81/00 211/100
7,293,662 B2 * 11/2007 Klein ..... A47B 61/04 211/35
7,316,324 B1 * 1/2008 Myllykangas ..... A47K 10/04 211/16
8,596,590 B2 * 12/2013 McCoy ..... F16M 13/02 248/68.1
8,671,545 B1 * 3/2014 Zimmerman ..... A47G 25/0635 211/16
9,289,065 B1 * 3/2016 Lambertson ..... A47K 10/04
9,326,601 B2 * 5/2016 Gupta ..... A47B 57/42
12,053,088 B2 * 8/2024 Moss ..... A47B 96/06
2007/0175842 A1 * 8/2007 Shieh ..... A47K 10/10 211/88.04
2023/0099317 A1 * 3/2023 Tighe ..... A47B 81/005 211/85.7

* cited by examiner

FRISBEE HOLDER

BACKGROUND

Flying discs, sometimes known as Frisbees, are typically formed as an integral rigid tough plastic shell, in a dished shape of about 8-12 inches in diameter. Disc golf is one common way to utilize discs. In disc golf, each hole includes a tee position for starting play and a disc golf target some distance away, often with obstacles such as trees, hills or bodies of water in between. Players begin by throwing a disc from the tee, without crossing over the front of the tee prior to releasing the disc when throwing. Players then navigate the hole by picking up the disc where it lands and throwing again until they reach the target. The object of the game is to get through the course with the lowest number of total throws. The prior art patent literature describes various systems relating to disc golf.

For example, U.S. Pat. No. 8,827,845 describes a disc golf practice tower which includes a plurality of vertically stacked baskets that collect discs that are thrown into a front opening of each basket, and which are used as a means of practicing disc golf putting or in connection with a game. The baskets are formed from a plurality of tubular components that connect, and from which netting spans along each basket at a rear surface, side surfaces, and a bottom surface. A top basket includes a backboard that enables a bank shot to be made therein. The tubular construction of the practice tower can collapse between uses, and arise from base members that secure the practice tower upon different ground surfaces.

However, U.S. Pat. No. 8,827,845 and other prior art disclosures do not provide a convenient means for storing discs for disc golf.

SUMMARY OF INVENTION

Therefore, the present invention provides a device for storing discs for use in disc golf or otherwise.

According to an aspect of the present invention, there is provided a disc holder, comprising: a first end plate; a first mounting bracket; a second end plate; a second mounting bracket; a first tube; and a second tube, wherein: the first end plate is configured to attach to the first mounting bracket; the second end plate is configured to attach to the second mounting bracket; the first tube connects the assembly of the first end plate and the first mounting bracket to the second end plate and the second mounting bracket along a first line; and the second tube connects the assembly of the first end plate and the first mounting bracket to the second end plate and the second mounting bracket along a second line to define a space for holding Discs between the first tube and the second tube.

DETAILED DESCRIPTION

Figure 1:
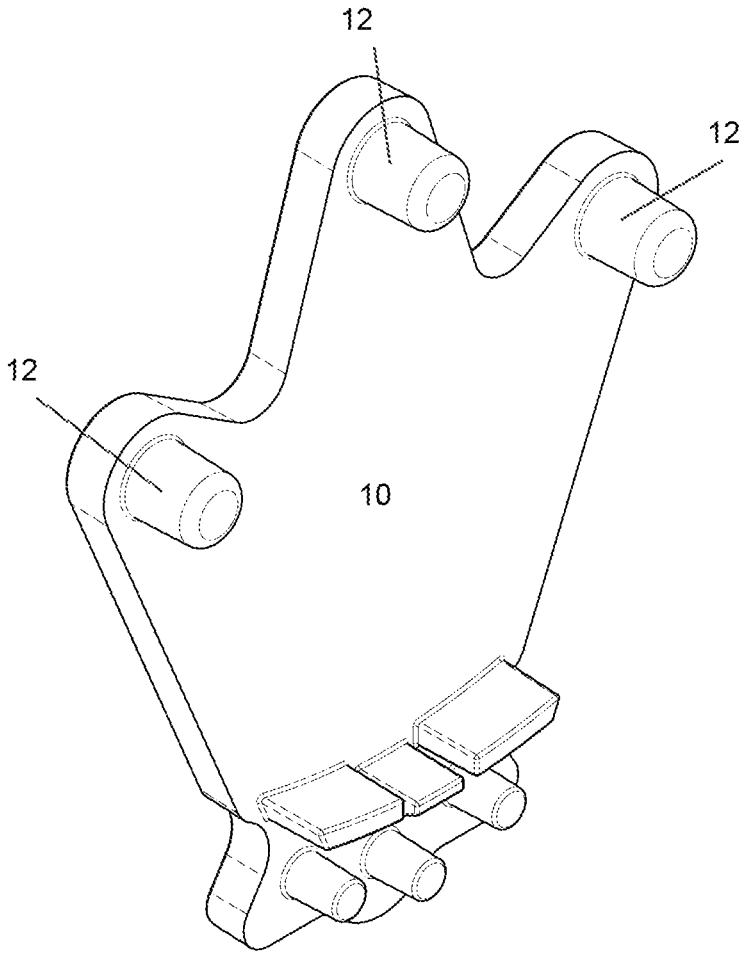
FIG. 1 illustrates an end plate according to an embodiment of the present invention.

FIG. 1 illustrates an end plate according to an embodiment of the present invention.

End plate 10 has three protrusions 12 for supporting discs when the embodiment is assembled for use. Protrusions 12 are configured to contain discs at a top end of the discs.

Figure 2:
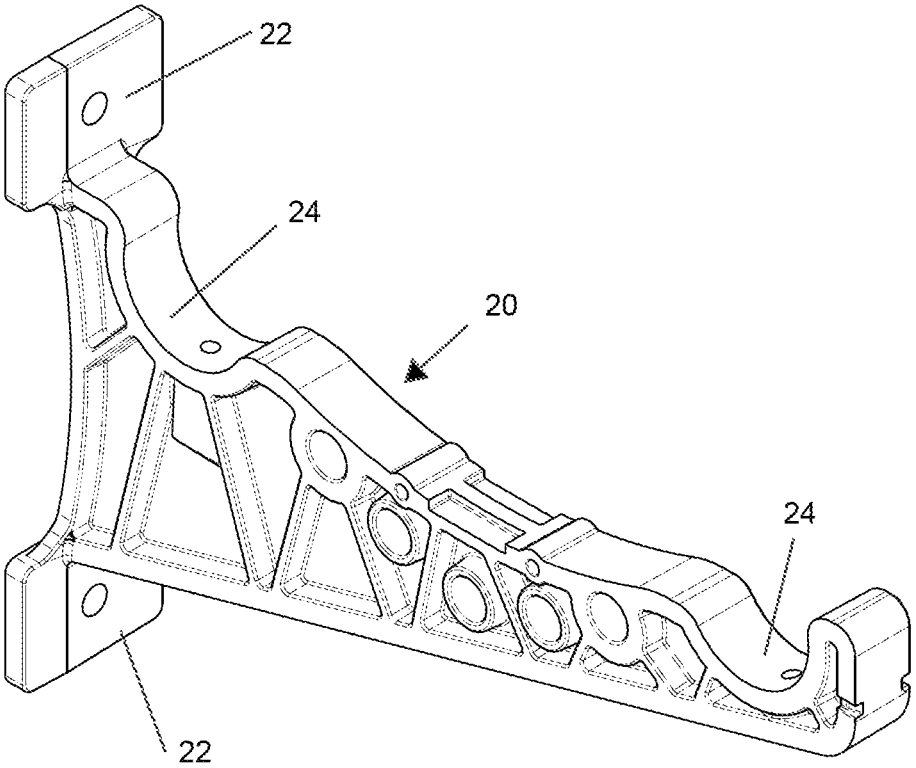
FIG. 2 illustrates mounting bracket according to an embodiment of the present invention.

FIG. 2 illustrates mounting bracket according to an embodiment of the present invention.

Mounting bracket 20 has screw holes 22 which can be used to attach the mounting bracket to a wall, for example. Rod holding recesses 24 is configured to receive first and second rods for containing discs at a bottom end of the discs.

Figure 3:
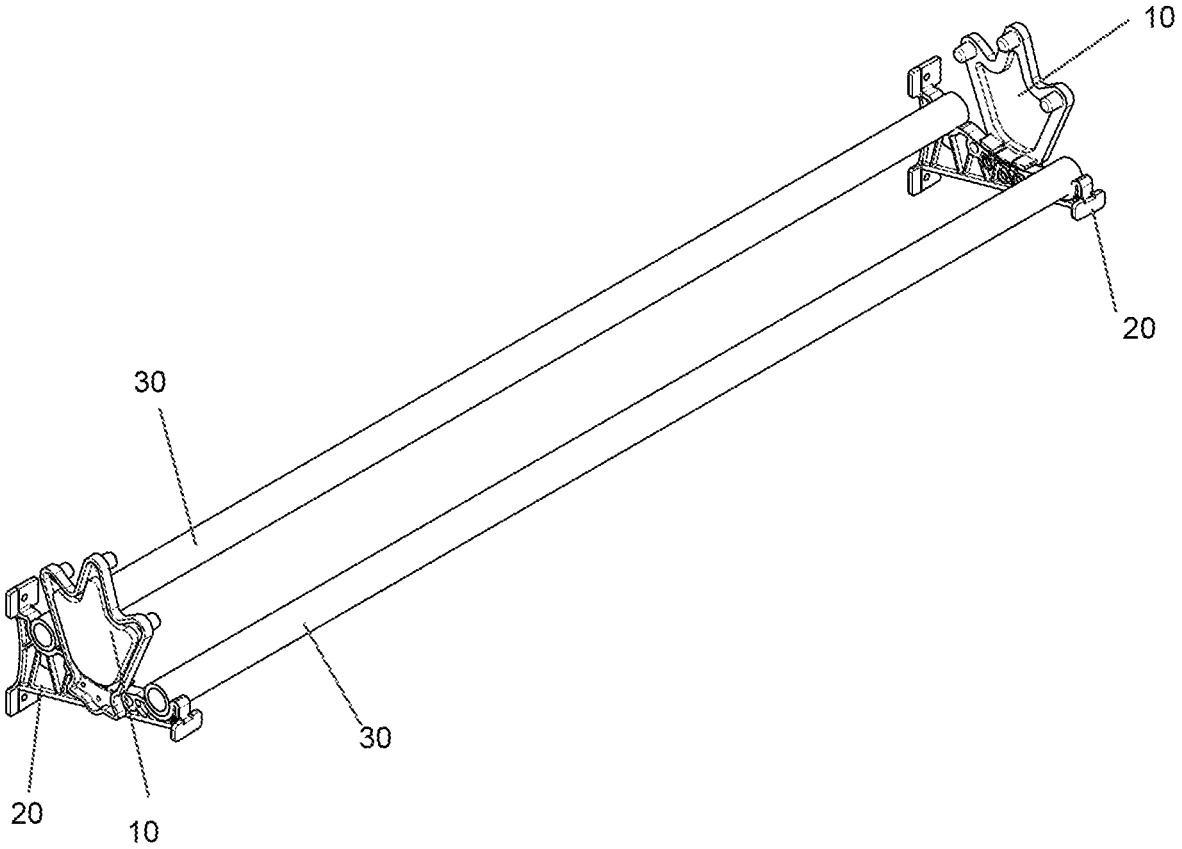
FIG. 3 illustrates an assembled device according to an embodiment of the present invention.

FIG. 3 illustrates an assembled device according to an embodiment of the present invention.

End plates 10 are attached to mounting brackets 20 which are spaced a distance apart. End plates 10 can have a plurality of protrusions at the bottom for connecting to mounting brackets 20, or the end plate and mounting brackets can be provided as a one piece assembly. Rods 30 connect the end plate and mounting bracket assemblies on either end to each other. The length of the rods and the spacing can be varied in embodiments depending on the number of discs to be held.

Figure 4:
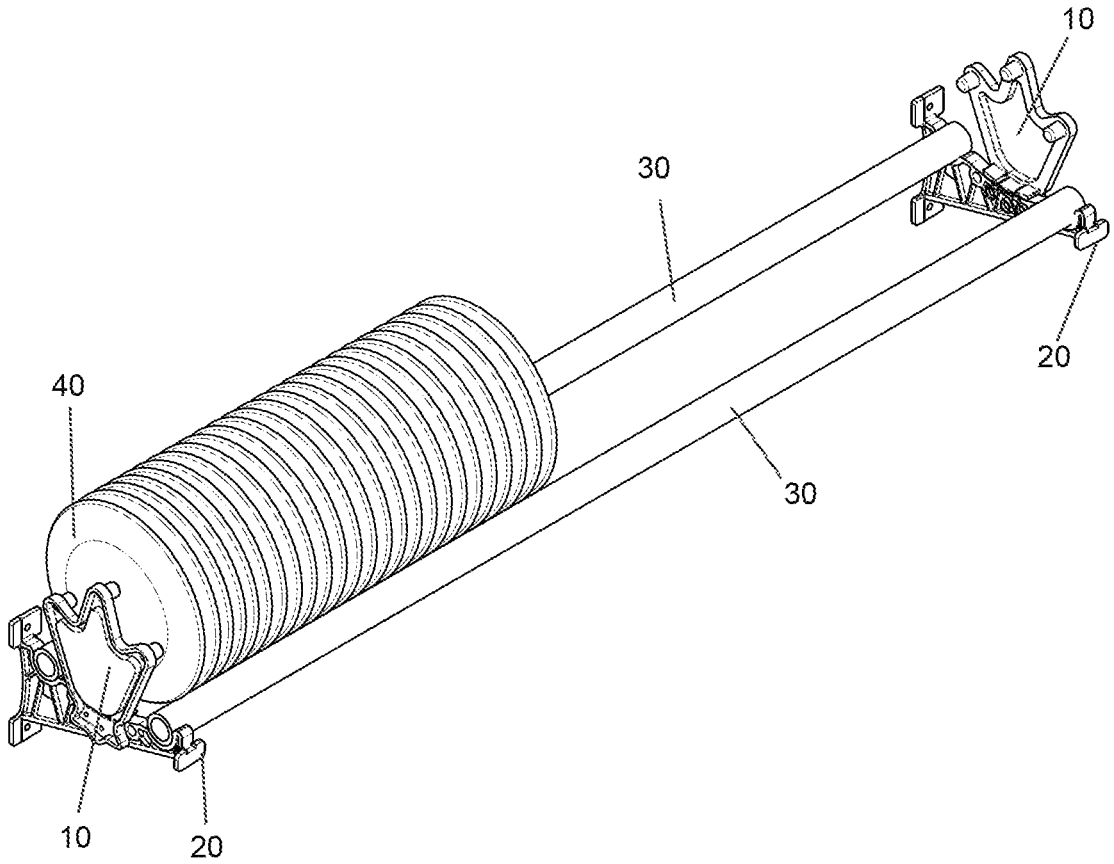
FIG. 4 illustrates the assembled according to an embodiment of the present invention holding discs.

FIG. 4 illustrates the assembled according to an embodiment of the present invention holding discs.

Discs 40 are positioned on top of rods 30 which are spaced with a gap in between the rods to allow for the discs to rest on top of the rods. End plates 10 and mounting brackets 20 contain discs 40 on the side of the discs. Discs can be various sizes and depending on the size of the discs the protrusions from end plates 10 may be above the top of the discs or may meet the discs on the sides.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description. Therefore, it is intended that the disclosure not be limited to the particular embodiment(s) disclosed.

What is claimed is:

1. A disc holder for storing disc golf discs, comprising: a first end plate having protrusions configured to contain disc golf discs; a first mounting bracket configured for direct wall mounting; a second end plate having protrusions configured to contain disc golf discs; a second mounting bracket configured for direct wall mounting; a first tube; and a second tube, wherein: the first end plate is configured to attach to the first mounting bracket; the second end plate is configured to attach to the second mounting bracket; the first tube connects the assembly of the first end plate and the first mounting bracket to the second end plate and the second mounting bracket along a first horizontal line; and the second tube connects the assembly of the first end plate and the first mounting bracket to the second end plate and the second mounting bracket along a second horizontal line parallel to the first horizontal line; the first tube and second tube are spaced apart at a precise distance configured to support disc golf discs in stable vertical orientation between the tubes.

2. The disc holder of claim 1, wherein the first mounting bracket and the second mounting bracket have screw holes for secure direct wall mounting.

3. The disc holder of claim 1, wherein the first mounting bracket and the second mounting bracket have two U-shaped indentations on top configured to receive the first tube and the second tube in parallel horizontal orientation.

4. The disc holder of claim 1, wherein the first end plate and the second end plate have protrusions at the top configured for containing disc golf discs at their edges to prevent lateral movement.

5. The disc holder of claim 1, wherein the first mounting bracket and the second mounting bracket have one or more openings on the bottom for receiving the first end plate and the second end plate respectively to form a stable disc containment assembly.

6. The disc holder of claim 1, wherein the first end plate and the second end plate have protrusions at the bottom for connecting to the first and second mounting brackets respectively to create a rigid support structure.

7. The disc holder of claim 1, wherein mounting brackets are configured to maintain the first tube and second tube at the same elevation in parallel horizontal orientation for stable disc support.

* * * * *